United States Patent [19]

Bugallo et al.

[11] Patent Number: 4,563,003

[45] Date of Patent: Jan. 7, 1986

[54] WEIGHT LIFTING APPARATUS HAVING INCREASED FORCE ON THE RETURN STROKE

[76] Inventors: Fernando Bugallo, 36 Greenwood Ave., Darien, Conn. 06820; Rafael Giamba, 632 Newfield Ave., Stamford, Conn. 06905

[21] Appl. No.: 485,320

[22] Filed: Apr. 15, 1983

[51] Int. Cl.[4] ..... A63B 21/06

[52] U.S. Cl. ..... 272/118; 272/134

[58] Field of Search ..... 272/118, 117, 129, 134, 272/140, 142, 143

[56] References Cited

U.S. PATENT DOCUMENTS

| | | | |
|---|---|---|---|
| 3,112,928 | 12/1963 | Oswald | 272/144 X |
| 3,573,865 | 4/1971 | Annas et al. . | |
| 3,588,101 | 6/1971 | Jungreis . | |
| 3,902,480 | 9/1975 | Wilson . | |
| 4,138,106 | 2/1979 | Bradley . | |
| 4,235,437 | 11/1980 | Ruis et al. . | |
| 4,239,210 | 12/1980 | Lambert | 272/118 |
| 4,387,893 | 6/1983 | Baldwin | 272/134 X |

*Primary Examiner*—Richard J. Apley
*Assistant Examiner*—William R. Browne
*Attorney, Agent, or Firm*—St. Onge, Steward, Johnston & Reens

[57] ABSTRACT

A weight-lifting apparatus operable by a person for weight training. The apparatus has a frame; a plurality of weights mounted on said frame for generally vertical reciprocal movement from a rest position upwardly against gravity force to an upper position, and downwardly from said upper position under said gravity force to said rest position. The apparatus also has a structure for lifting said weights against said gravity force and lowering said weights under said gravity. A resisting force in addition to said gravity force on the weight is applied to said structure during at least a portion of said downward movement of said weights.

13 Claims, 6 Drawing Figures

WEIGHT LIFTING APPARATUS HAVING INCREASED FORCE ON THE RETURN STROKE

BACKGROUND OF THE INVENTION (1) Field of the Invention

The present invention relates to a weight-lifting apparatus of the type including a plurality of weights mounted on a frame for generally vertical reciprocal movement by a force imparted by a person using the apparatus.

(2) Description of the Prior Art

Many conventional weight-lifting devices include a frame which supports the user and a plurality of weights mounted on the frame. The weights are mounted on guide rods for generally vertical reciprocal movement from a rest position upwardly against gravity force to an upper position. Lifting of the weights is accomplished by the user who actuates a bar or other device operably connected to the weights. For any exercise, the number of weights lifted can be selected by the user. In the case where the user is doing arm curls, for example, during the lifting stroke of the weight-lifting apparatus, the user grasps a bar with his hands and pulls upwardly to lift the weights operably connected to the bar. When the person has completed the lifting stroke of the bar, the bar is allowed to return to its rest position. During return of the bar to its rest position, the user restrains the bar so it moves slowly back to its rest position. In a conventional weight-lifting apparatus, the weight to be lifted by the user during the lifting stroke is the same as the weight that is restrained by the user during the return stroke.

It is known that a person lifting weights may be able to lift only a predetermined amount of weight but can restrain the movement of a larger amount of weight. Thus, for many exercises, a conventional weight-lifting apparatus under-utilizes a person's capability during the return stroke of the device. It would be desirable to provide a weight-lifting apparatus wherein the force required to restrain the weights during the return stroke is substantially greater than the force necessary to lift the weights.

In a weight-lifting apparatus designed for arm curls, the user places his arms on a table and grasps with his hands the bar that is operably connected to the weights. The portion of the arms that rest on the table are those located immediately above the elbow. The table is generally planar and positions the upper arms of the user at a given angle with respect to the bar being curled against the force of the weights. In a conventional apparatus for arm curls, the table is either fixed in position with respect to the bar being curled, or is pivotal with respect to the bar as is shown in U.S. Pat. No. 4,239,210 to Lambert. It is believed to be undesirable to allow the table to pivot as the bar is curled because pivoting of the table increases the leverage available to the user and thereby decreases the amount of force necessary to lift the weights. It would be desirable to provide a table which can be fixed during exercise, but which can be adjusted to vary its angle with respect to the bar. Thus, the user and his exerciser team could perform a series of curls with the table at one angle, thus exercising a portion of the muscles, and then change the angular orientation of the table and exercise another portion of the muscles.

SUMMARY OF THE INVENTION

In accordance with the present invention, a weight-lifting apparatus is provided, and includes a mechanism for increasing the force required to be restrained by the user during the return stroke of the weights. The weight-lifting apparatus includes a frame supporting a plurality of weights mounted thereon for generally veritical reciprocal movement from a rest position upwardly against gravity force to an upper position. The movement of the weights from a rest position to an upper position is referred to as the lift stroke of the apparatus. The weights are moveable downwardly from the upper position under the gravity force to a rest position, and this movement is referred to as the return stroke of the apparatus.

The weights are operated by a bar or other actuating mechanism that is grasped or in some other manner moved by a user. The actuating mechanism may comprise a bar, a pulley system, a lever or other mechanisms conventionally used in weight-lifting apparatus. It should be understood that the arm curl apparatus shown in the drawings, is shown by way of example only, and that other mechanisms for enabling the person to operate the weights may be used.

In accordance with the invention, the weight-lifting apparatus includes a mechanism for imposing a force in addition to the gravity force of the weights on the actuating means during at least a portion of the downward movement of the weights so that the user must restrain movement of a larger amount of weight than he lifted.

In accordance with one aspect of the invention the mechanism for imposing the force comprises a rod moveable generally vertically through a downward stroke and an upward stroke. The apparatus includes means for sensing the location of the weights at the upper position of the lift stroke. When the weights reach this upper point, the sensing mechanism actuates a drive motor which moves the rod vertically downwardly. The end of the rod contacts the weights and forces the weights downwardly. A second sensing means senses the lowermost extension of the rod during the downward stroke and actuates the drive motor to reverse the direction of movement of the rod and return it quickly to its rest position. Once in its rest position, the rod ceases movement until it is once again actuated by the first sensing mechanism.

In accordance with one aspect of the invention, the rod for imposing additional force on the weights is moveable at a relatively constant speed, preferably a speed between 3 and 5 inches per second. This constant speed movement of the rod enables the weight-lifting apparatus to be used safely. If the weight becomes too strenuous for the user to restrain, the user may simply allow the weights to move downwardly faster than the rod is moving. As soon as the speed of the downward movement of the weights is greater than the speed of the rod, no additional force is provided by the rod, and the person operating the apparatus may quickly and safely lower the weights to a rest position.

In accordance with one aspect of the invention, the force urging the rod downwardly is adjustable. For example, if the user desires to lift 30 lbs., he selects the number of weights so that the weight to be lifted is 30 lbs. as is done in a conventional weight-lifting apparatus. The user then selects the force imposed by the rod, such as, for example, an additional 10 lbs. so that the user must restrain 40 lbs. during the return stroke. If the user desired to lift 100 lbs., the rod force may be adjusted upwardly to 30 lbs.

Although it is preferred that the rod be driven by a conventional electrical motor, it should be understood that other mechanisms for driving the rod in a reciprocal motion may be used including a hydraulic piston and cylinder, or other mechanical mechanisms for moving the rod in a reciprocal fashion in response to the sensing switches.

In accodance with one aspect of the invention, the weight-lifting apparatus is used for arm curl exercises. In this aspect of the invention, the apparatus includes a generally planar table, which is preferably but not necessarily padded. The table is for placement of the upper arms immediately above the elbow of the person using the device. The device further includes a bar that is located in front of the table and which is grasped by the user. During exercise, the user curls the bar thus rotating it with respect to an axis. In a conventional arm curling apparatus, the plane of the table is fixed and the bar pivots with respect to the table. In accordance with the present invention, the device includes a mechanism for adjusting the angle of the plane of the table so that the plane of the table can be positioned at various angles. However, it should be understood that during exercise, the table remains in fixed position as the bar moves. The user may perform a series of exercises with the table adjusted at one angle. After the series of exercises is completed, the user may adjust the angle of the table with respect to the bar, and perform another series of exercises. By repeated adjustment of the table and continued exercise by the user, the user can fully exercise his arms during the exercise.

The table is mounted on an axle that is journaled at either side in holes in the frame members at either side. A lever extending transversely to the axle is fixed thereto and includes at the end of the lever a mechanism for releasably securing the end of the lever to an adjacent portion of the frame. More specifically, the lever at the end thereof includes a spring-loaded plunger that is biased toward the frame. The frame includes a plurality of holes for receiving the plunger. In order to adjust the position of the table, the plunger is manually moved against the spring bias to withdraw the plunger from one of the holes in the frame. Thereafter, the axle and the arm rest are rotated so that the plunger is in alignment with another hole in the frame at which time the plunger is released to reposition the table.

In accordance with another aspect of the invention wherein the apparatus is used for arm curls, the horizontal bar which is rotated through an arc includes two handles mounted on the bar for rotation about axis parallel to the bar. Each handle includes at least two hand-grips, and for each handle the grips are angled with respect to each other. For example, one grip preferably extends parallel to the bar and another grip extends at an angle preferably between 30 and 60 degrees and most preferably at 45° with respect to the other handle. The user can perform one set of exercises grasping the parallel hand-grips thereby exercising one group of muscles. Thereafter, the user can perform another set of exercises grasping the other set of handles thereby exercising a different group of muscles. The handles may each include more than two hand-grips, or may each include a hand-grip that is adjustable in angular relation to the bar.

Additional advantages of a weight-lifting appratus in accordance with the present invention will be described in the detailed description of the invention with reference to the drawings.

DETAILED DESCRIPTION OF THE INVENTION

Figure 1:
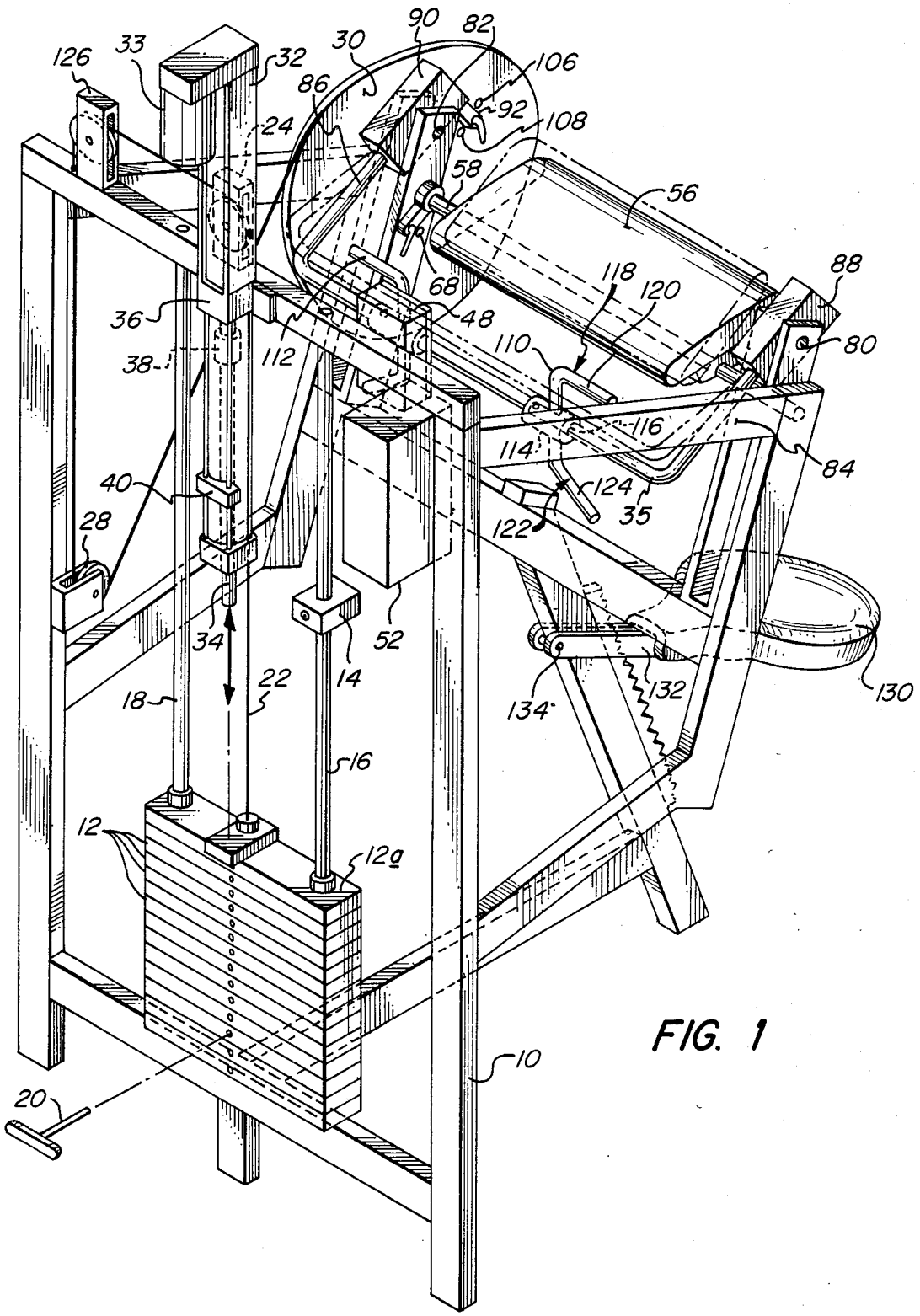
FIG. 1 is a perspective view of a weight-lifting apparatus in accordance with the present invention.
Figure 2:
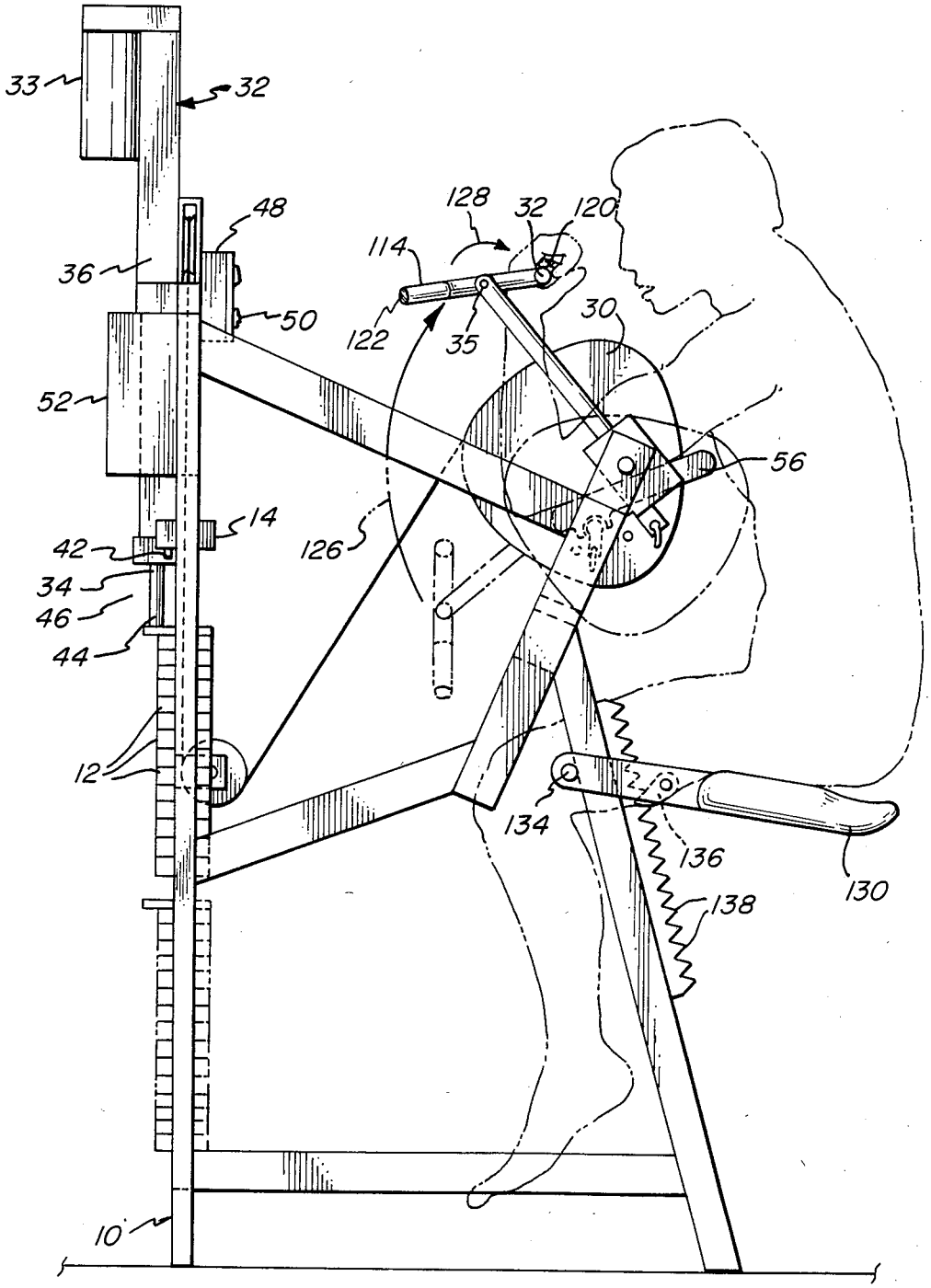
FIG. 2 is a side plan view of the weight-lifting apparatus in accordance with the present invention being used by a person.
Figure 3:
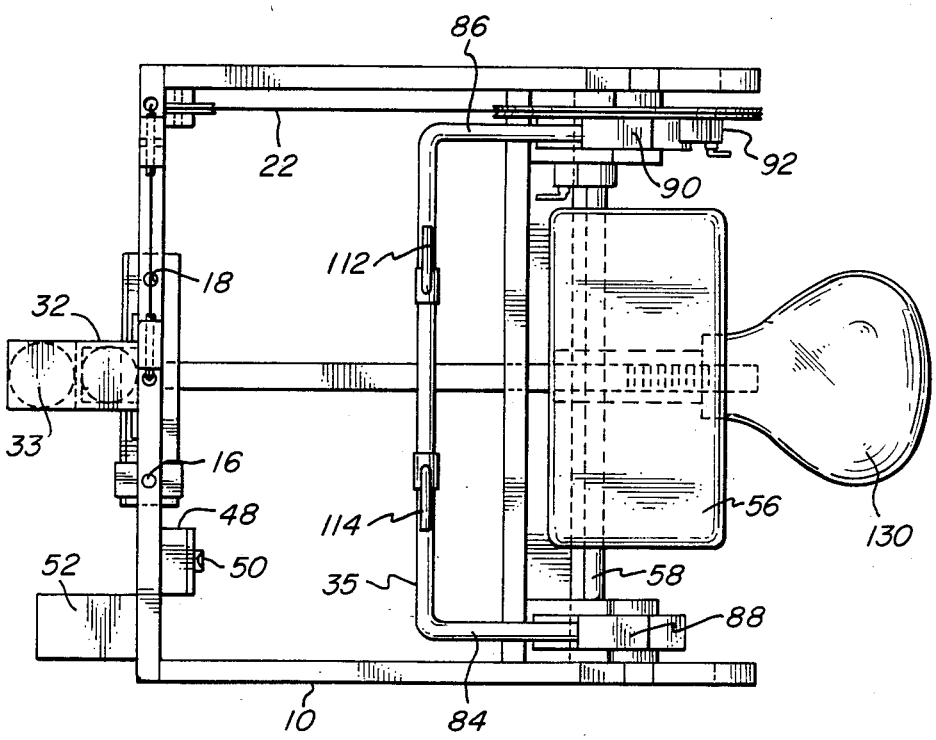
FIG. 3 is a top plan view of the weight-lifting appratus shown in FIG. 1.

Referring to FIGS. 1, 2 and 3, a weight-lifting apparatus in accordance with the present invention includes a frame 10 for supporting the various components of the apparatus. A plurality of weights 12 are mounted on the frame for generally vertical reciprocal movement from a rest position as shown in FIG. 1 upwardly against gravity to an upper position wherein weight 12*a* contacts a sensing switch 14. The weights 12 are mounted on guide bars 16 and 18 for sliding movement with respect to the bars. The amount of weight to be lifted is selected by inserting a key 20 in the appropriate weight. It should be understood that the weights are typically ten pounds apiece, and the user simply selects the amount of weight he wishes to lift by placing the key 20 in the appropriate hole of a weight.

The weights are lifted and lowered by an actuating mechanism which comprises a cord 22 attached to the weight and that is routed through a plurality of pulleys 24, 26 and 28 to a cam wheel 30. As best shown in FIG. 2, cam wheel 30 is rotated by grasping handles 110 and 112 to rotate bar 35 which is fixed with respect to the cam wheel 30. It should be understood that the mechanism for actuating the weights including the cord and the plurality of pulleys is shown by way of example only and that other mechanisms for actuating the weights may be used including levers which operate either directly or indirectly on the weights or other mechanisms.

The apparatus shown in FIGS. 1 through 3 is suitable for arm curls. However, it should be understood that the invention is not limited to an apparatus for arm curls, but rather can be applied to various types of exercising machines including those for pressing weights to strengthen the upper body, or leg exercises, for example, UNIVERSAL and NAUTILUS equipment and other equipment that work on the principal of raising and lowering a plurality of weights.

In accordance with a primary object of the invention, a mechanism for imposing a force in addition to the gravity force of the weights on the actuating mechanism so that the user must restrain a larger amount of force during the return stroke of the weights than during the lifting stroke of the weights. The mechanism for imposing the additional force is shown at reference character 32 and includes a rod 34 moveable generally vertically through a downward stroke and an upward stroke. As will be described in greater detail hereinafter, during the downward stroke of the rod 34, the rod imposes an additional force on the weights to increase the amount of force necessary by the user to restrain movement of the weights.

The mechanism 32 which operates rod 34 is an electrical cylinder commercially available including a reversable motor 33 for driving the rod 34 via mechanical means contained in housing 36. As shown in FIG. 1, rod 34 is moveable reciprocally within housing 36. A magnet 38 is mounted on rod 34 and reciprocates therewith. A magnetic switch 40 senses location of magnet 38 at the height of switch 40 and through electrical circuitry (not shown) reverses the direction of electric motor 33 thereby moving rod 34 upwardly. Also, as shown in FIG. 1, contact sensing switch 14 is provided and includes a button 42 or other contact sensing mechanism which senses contact by the weights when they reach the upper position of the lift stroke.

The weight-lifting apparatus is operated as follows. The person lifting the weights 12 through a mechanism operable to lift the weights against gravity force imparts a force on cord 22 via bar 35 and cam wheel 30. As the weights are lifted against the force of gravity, the weights slide upwardly and are guided by guide rods 16 and 18 until they reach the upper position of the lift stroke at which the time the weights contact button 42 of contact sensing switch 14. The contact sensing switch through electrical circuitry, not shown, switches on drive motor 33 which, in turn, moves rod 34 downwardly. As shown in FIG. 2, the end 44 of rod 34 contacts the top weight of the group of weights 12. The rod 34 now moves in the direction shown by arrow 46 in FIG. 2. The person grasping handle 32 now experiences an increased force which he must resist during downward movement of the weights during the return stroke. Thus, the user must exert a predetermined force to lift the weights and then must exert a greater force to restrain the weights during the return stroke.

As the weights are lowered, the magnet 38 moves downwardly with rod 34 and comes into horizontal alignment with magnetic sensor 40 at which time the drive motor is reversed and the rod moves upwardly to its rest position as shown in FIG. 1. The apparatus is now in position for an additional cycle.

The rod 34 preferably moves during its down stroke at a constant speed, and most preferably a speed of between about 3 and 5 inches per second. The user by lowering the weights at a speed less than the speed of the rod experiences increased resistance and must exert himself to a higher degree to restrain the weights. However, if the user should tire, the weights can be lowered more quickly so that they travel downwardly at a speed greater than the speed of downward movement of rod 34, and no additional force need be restrained by the user. Thus, the device is safe in that no additional weight is actually added to the device unless the user desires to work against the movement of the rod 34. In the apparatus described, the speed of movement of the rod is set by the manufacturer and is fixed. It should be understood that, if desired, a rod speed could be adjustable by the user by provision of a user adjustable control.

In one embodiment of the invention, a control box 48 is provided and has a dial 50 on the face thereof which allows the user to adjust the force of the rod 34. Thus, in instances where the user desires to lift a large amount of weight, such as 100 lbs., the user can adjust the rod for a large force such as 30 lbs. When the user lifts 30 lbs., the force of the rod may be decreased to 10 lbs. The ratio between the force of the rod and the weight being lifted is preferably 20 to 40 percent, but the user may select whatever ratio is suitable.

The wiring box 52 contains the wiring for the motor 33 and the contact switch 14 and the magnetic sensing switch 40. The wiring has been omitted from the drawings so that the mechanical components of the apparatus can better be seen.

As described above, the mechanism for driving rod 34 comprises a conventional electrical cylinder that is commercially available. It should be understood that other mechanisms for exerting a force on the weights 12 may be used and include, for example, a hydraulic cylinder, mechanical gearing, or other conventional mechanisms.

Figure 4:
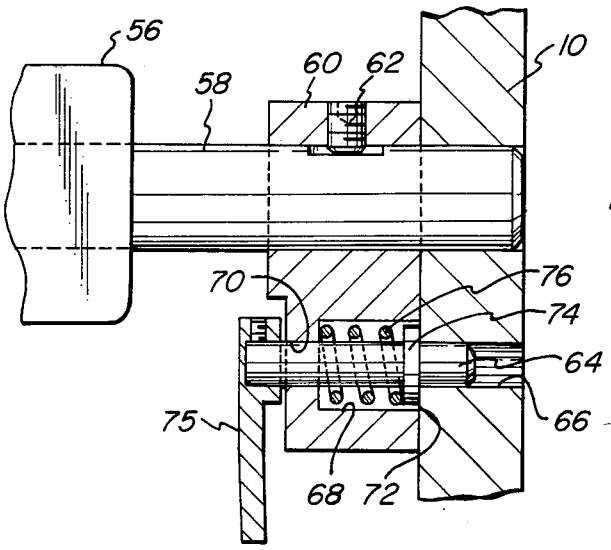
FIG. 4 is a sectional view of the mechanism for adjusting the angle of the table and for locking the table in place.
Figure 5:
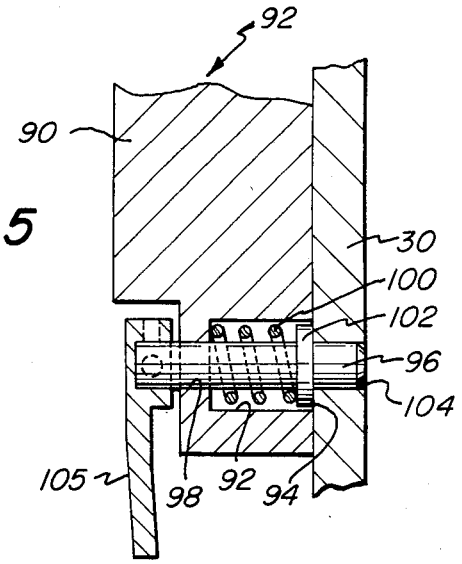
FIG. 5 is a sectional view of the mechanism for adjusting the angle of the bar with respect to the wheel.

In accordance with another aspect of the invention, an arm curl apparatus is provided which allows proper angular adjustment of the table and adjustment of the bar which is grasped to lift the weights. Referring to FIGS. 1, 2 and 4, the device includes a padded table 56 on which the user of the apparatus rests the upper portion of his arms, as best shown in FIG. 2. The table is secured to an axle 58 which has its ends journaled in the frame 10. This relationship is best shown in FIG. 5. A lever arm 60 is attached to axle 58 by conventional means such as a set screw 62 so that the lever arm 60 rotates with axle 58. The lever arm 60 extends radially with respect to the axle 58 and includes a spring loaded plunger 64 which is positioned within one of several holes 66 in the frame. As shown particularly well in FIGS. 1 and 4, the plunger 64 is located in hole 66 of frame 10 thereby preventing rotation of the axle and fixing table 56 at a particular angle.

As shown in FIG. 1, the frame includes at least two or more holes 66 and 68 which allows for angular adjustment of table 56. More specifically, referring to FIG. 4, the end of lever 60 includes a cavity 68. The plunger extends through an aperture 70 in the lever arm into the cavity and then through an opening 72 in cavity 68. The plunger includes a spring retaining ring 74 which confines a helical spring 76 between it and the rear boundary of the cavity. Spring 76 biases the plunger 64 outwardly into hole 66 on the frame. If the user desires to switch or change the angular orientation of the table, he merely pulls outwardly on handle 75, which is attached to the end of plunger 64, and moves the plunger against the bias of spring 76 out of hole 66. The lever arm 60 may then be rotated until the plunger 64 is in alignment with another hole, such as hole 66 as shown in FIG. 1. Then the handle 75 may be released to allow the plunger 64 to be biased downwardly into hole 68, thereby locking the table in another angular position. It should be understood that during the course of exercise, the user may accomplish a set of exercises with the table positioned at one angle, then change the angle of the table, and undertake another set of exercises. By adjusting the angle of the table to various angles, the arms of the person operating the device can be fully exercised.

As shown in FIG. 1, bar 35 is pivotal with respect to frame 10 about pins 80 and 82. Bar 35 includes levers 84 and 86 which space bar 35 a radial distance from pins 80 and 82. Levers 84 and 86 are mounted respectively in pivot blocks 88 and 90 which pivot respective on pins 80 and 82. Cam wheel 30 is positioned adjacent one of the pivot blocks 90. As shown in FIGS. 1 and 5, the device includes an adjustment mechanism 92 for adjusting the angle of the bar 35 with respect to the angle of the table when the apparatus is in a rest position. Referring in particular to FIG. 5, pivot block 90 includes a cavity 92 having an opening 94 at one end thereof. Plunger 96 is inserted into cavity 92 through a hole 98 in the pivot block 90. A helical spring 100 is positioned in cavity 92 and is restrained by retaining ring 102. The spring 100 biases the plunger 96 into a hole 104 in wheel 30. As shown in FIG. 1, the wheel 30 may include a plurality of holes 106 and 108 which enable the bar 35 to be positioned at various angles with respect to the table 56. In order to change the position of the bar, the plunger 96 is removed from hole 104 by pulling the handle 105 outwardly against the bias of spring 100. The plunger 96 is then rotated into alignment with another hole, such as, for example, either a hole 106 or 108. The plunger is then released and the arm 35 is once again locked in position and is ready for use.

As shown in FIG. 1, hand-grips 110 and 112 are rotatably mounted on bar 35. Since hand-grip 110 is identical to hand-grip 112, only hand-grip 110 will be described. The hand-grip includes a housing 114 having a cylindrical passage 116 that receives and rotates with respect to bar 35. The hand-grip includes at least two handles projecting radially therefrom. Handle 118 includes a grip 120 that extends generally parallel with respect to the bar 35 whereas hand-grip 122 includes a grip 124 that extends at an angle of approximately 45 degrees with respect to the bar 35.

As shown in FIG. 2, as the bar 35 is rotated through an arc as shown by arrow 126, both handles 114 and 112 rotate through an arc shown by arrow 128. As shown in FIG. 3, the user is grasping the handle 118 that extends parallel with respect to bar 35. As an alternate form of exercise, the user can grasp the handle 122 that is angled with respect to the bar 35 to thereby exercise a different set of muscles. The user can perform one set of exercises grasping the parallel hand-grips thereby exercising one group of muscles. Thereafter, the user can perform another set of exercises grasping the other set of handles thereby exercising a different group of muscles. The handles may each include more than two hand-grips, or may each include a hand-grip that is adjustable in angular relation to the bar.

Figure 6:
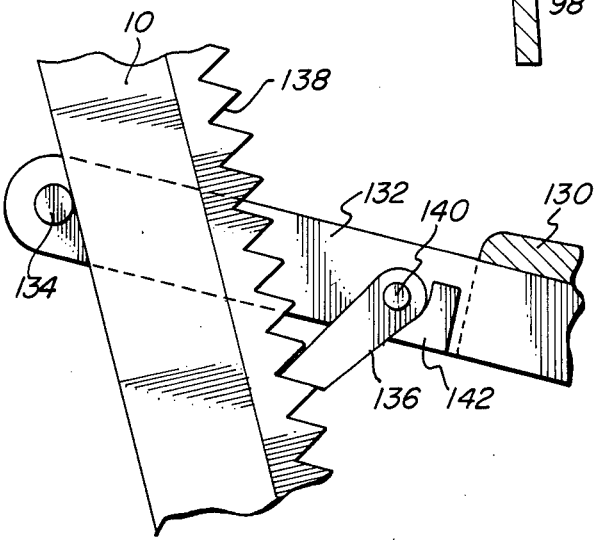
FIG. 6 is an enlarged side view of the device for adjusting and locking the seat.

Referring to FIGS. 1 and 6, the conventional mechanism for adjusting the height of the seat is shown. The seat 130 is mounted on a lever arm 132. The end of lever arm 132 includes a pin 134. At a point intermediate the pin 134 and the seat 130, a pawl 136 for engaging serrations 138 on the frame 10 is provided. The pawl is placed in one of the grooves between serrations 138 to fix the positions of lever arm 132 thus fixing the position of seat 130.

A weight-lifting apparatus in accordance with the present invention provides for increased exercising during the return stroke of the weights, thereby fully exercising the user's muscles. The table and the bar are adjustable in angular relation to each other to provide for variations in the positioning of the user, and thus variations in the muscles exercised.

It should be understood that although specific embodiments of the invention have been described herein in detail, such description is for purposes of illustration only and modification may be made thereto by those skilled in the art within the scope of the invention.

We claim:

1. A weight-lifting apparatus operable by a person for weight training comprising:

a frame;

a plurality of weights mounted on said frame for generally vertical reciprocal movement from a rest position upwardly against gravity force to an upper position during a lifting stroke, and downwardly from said upper position under said gravity force to said rest position during a negative stroke;

actuating means operable to lift said weights against said gravity force and lower said weights under said gravity force; and;

means imposing a force in addition to said gravity force of said weights on said actuating means during at least a portion of said downward movement of said weights to provide for restraint of a greater force on the negative stroke than on the lifting stroke.

2. A weight-lifting apparatus according to claim 1 wherein said means for imposing a force comprises a rod moveable generally vertically through a downward stroke and an upward stroke, said apparatus including a means for sensing location of said weights at said upper position of their movement, means for sensing the lowermost extension of said rod in said downward stroke, means for driving said rod actuated by said two sensing means, said first sensing means actuating said drive means to move said rod through its downward stroke, said second sensing means actuating said drive means to reverse the direction of movement of said rod and return it to a rest position.

3. A weight-lifting apparatus according to claim 2 wherein said first sensing means comprises a contact switch located at the upper position of said weights, said contact switch being contacted by said weights to actuate said drive means to move said rod through its downward stroke, said rod including an end portion for contacting said weights, said end portion during said downward stroke contacting and imposing said additional force on said weights.

4. A weight-lifting apparatus according to claim 3 wherein said rod is moveable at a constant speed through its downward stroke.

5. A weight-lifting apparatus according to claim 4 wherein said rod is moveable at a speed between 3 and 5 feet per second.

6. A weight-lifting apparatus according to claim 4 and further including means for adjusting the force of said rod during said downward stroke.

7. A weight-lifting apparatus according to claim 3 wherein said drive means comprises a reversible electric motor for moving said rod.

8. A weight-lifting apparatus for arm curling exercises for a person's arms comprising:

a frame;

a table for supporting the upper portion of said person's arms, said table being pivotal about an axis with respect to said frame;

means for locking said table in various fixed angular positions with respect to said frame;

a bar mounted for pivotal movement with respect to said frame, said bar including handle means for grasping said bar; and weight means operably connected to said bar and mounted on said frame for generally vertical reciprocal movement from a rest position upwardly against gravity force to an upper position, and downwardly from said upper position under said gravity force to a rest position, said bar being pivotable in one direction to lift the weights and being pivotable in an opposite direction to return said weights, and further including means for adjusting the initial angular position of the bar with respect to the frame.

9. An apparatus according to claim 8 wherein said arm extends generally parallel to the axle of said table and wherein each end of the arm includes a lever extending transverse to the arm and has an end thereof mounted on a pin to provide for pivoting of the lever with respect to the pins, said pins extending parallel to the axle of the table, said apparatus further including means for adjusting the initial angular position of the levers with respect to said pins.

10. A weight-lifting apparatus for arm curling exercises for exercising a person's arms comprising:

a frame;

a table for supporting the upper portion of said person's arms, said table being pivotal about an axis with respect to said frame;

means for locking said table in various fixed angular positions with respect to said frame;

a bar mounted for pivotal movement with respect to said frame, said bar including handle means for grasping said bar; and weight means operably connected to said bar and mounted on said frame for generally vertical reciprocal movement from a rest position upwardly against gravity force to an upper position, and downwardly from said upper position under said gravity force to a rest position, said bar being pivotable in one direction to lift the weights and being pivotable in an opposite direction to return said weights, and further including a seat, said seat being secured to a lever arm which is pivotal about an axle fixed with respect to said frame, said apparatus further including means for adjusting the angular position of the lever arm with respect to the frame.

11. A weight-lifting apparatus for arm curling exercises for exercising a person's arms comprising:

a frame;

a table for supporting the upper portion of said person's arms, said table being pivotal about an axis with respect to said frame;

means for locking said table in various fixed angular positions with respect to said frame;

a bar mounted for pivotal movement with respect to said frame, said bar including handle means for grasping said bar; and weight means operably connected to said bar and mounted on said frame for generally vertical reciprocal movement from a rest position upwardly against gravity force to an upper position, and downwardly from said upper position under said gravity force to a rest position, said bar being pivotable in one direction to lift the weights and being pivotable in an opposite direction to return said weights, and further including two handles mounted on the bar for rotation about an axis parallel to the bar, each handle having a plurality of hand-grips, angled with respect to each other.

12. An apparatus according to claim 11 wherein one said hand-grip extends parallel to the bar and said other hand-grip extends at an angle between 30 and 60 degrees with respect to said one hand-grip.

13. An apparatus according to claim 12 wherein said other hand-grip extends at an angle of about 45 degrees with respect to said one hand-grip.

* * * * *